US007074117B2

(12) United States Patent
Dore

(10) Patent No.: US 7,074,117 B2
(45) Date of Patent: Jul. 11, 2006

(54) BLASTING NOZZLE

(75) Inventor: David James Dore, Melbourne (GB)

(73) Assignee: Quill International Industries PLC, Derbyshire (GB)

( * ) Notice: Subject to any disclaimer, the term of this patent is extended or adjusted under 35 U.S.C. 154(b) by 0 days.

(21) Appl. No.: 11/225,959

(22) Filed: Sep. 14, 2005

(65) Prior Publication Data

US 2006/0063476 A1 Mar. 23, 2006

(51) Int. Cl.
*B24C 5/04* (2006.01)

(52) U.S. Cl. ..... 451/102

(58) Field of Classification Search ..... 451/36, 451/38, 39, 40, 75, 90, 102
See application file for complete search history.

(56) References Cited

U.S. PATENT DOCUMENTS 4,890,598 A * 1/1990 Kinsworthy ..... 126/110 D
6,165,053 A * 12/2000 Yokokawa et al. ..... 451/53
6,626,738 B1 * 9/2003 Shank ..... 451/39

* cited by examiner

*Primary Examiner*—Jacob K. Ackun, Jr.
(74) *Attorney, Agent, or Firm*—Egbert Law Offices

(57) ABSTRACT

A blasting nozzle for a blasting apparatus includes an inlet for attachment to the outlet hose of the blasting apparatus, an accelerating portion, and an outlet portion through which an accelerated abrasive-laden jet can be ejected. The outlet portion has an interior surface that flares outwards to define a single outlet orifice but that also defines a transverse cross-section profile having at least two lobes between which is at least one splitter element. In use, the abrasive within the jet is directed by the splitter element into one or other of the two lobes within the single egressing jet. The overall effect is such that the abrasive distribution transversely across the jet is much more even than in a conventional blasting nozzle.

12 Claims, 3 Drawing Sheets

BLASTING NOZZLE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a blasting nozzle primarily for use in an abrasive blasting apparatus and, in particular, in a dustless abrasive blasting apparatus. However, the nozzle is also suitable for use in water jetting and in wet and dry abrasive blasting.

BACKGROUND OF THE INVENTION

In dustless abrasive blasting, an abrasive is entrained in a pressurized fluid flow or gaseous-entrained liquid flow and is directed against the surface to be treated by a controllable nozzle. It is the intention of such apparatus to coat each particle of the abrasive with the liquid so that the abrasive is weighted by the liquid and falls safely to the ground after striking the surface to be blasted, generally obviating the requirement for the operator of the apparatus to wear breathing apparatus. The weighted abrasive also increases the efficiency of the blasting operation. Typically, the liquid used in abrasive blasting apparatus is water or a water based blasting solution, such as a rust inhibiting solution. Similarly, the pressurized gaseous streams used in blasting operations are typically pressurized air.

Conventionally, a nozzle used in such apparatus comprises an inlet for attachment to the outlet hose of the blasting apparatus, an accelerating portion typically in the form of a venturi, and an outlet portion defining an outlet orifice through which the accelerated abrasive-laden gaseous jet is ejected from the nozzle. The outlet portion can take various forms and typically is conical in shape so that it flares uniformly towards the outlet orifice. This produces a circular blast pattern wherein the abrasive content is concentrated at the center of the jet. In effect, the abrasive distribution transversely across the cross-sectional axes of the outlet portion of the nozzle is in the form of a standard bell-shaped distribution curve. This means that in use, the operator of the apparatus must sweep the nozzle such that each sweep always overlaps at least a part of the previous sweep to produce an even blasting pattern on the surface to be cleaned. The effect of this is that much abrasive tends to be wasted by being blasted onto surfaces that have already been blasted previously and that do not need additional blasting.

In order to overcome this problem, different shaped nozzles are sometimes used. For example, the outlet portion of the nozzle can be made in the shape of a fan so that the outlet orifice is in the shape of a narrow rectangle. However, even in this case, the abrasive distribution transversely along the longitudinal axis of the outlet orifice is still a standard bell-shaped distribution curve. Likewise, nozzles with square-shaped outlet portions and outlet orifices have been proposed but without significantly altering the abrasive distribution within the final jet, wherein the abrasive content is always at its highest at the center of a jet.

The object of the present invention is to provide a blasting nozzle for use in an abrasive blasting apparatus that overcomes or substantially mitigates the aforementioned problem by altering the abrasive distribution pattern of the resulting jet when the nozzle is in use.

BRIEF SUMMARY OF THE INVENTION

According to the present invention there is provided a blasting nozzle for use in an abrasive blasting apparatus comprising an inlet for attachment to the outlet hose of the blasting apparatus, an accelerating portion, and an outlet portion with an interior surface which flares outwards to define a single outlet orifice through which an accelerated abrasive-laden jet can be ejected, characterized in that the outlet portion has an interior surface that defines at least one splitter means and a transverse cross-section profile in that defines at least two lobes between the splitter means and the outlet orifice.

In such a nozzle, in the outlet portion much of the accelerated abrasive-laden gaseous jet tends to be directed by the splitter means into one or other of the two lobes, which are conjoined at the location of the splitter means so that they still form a single jet. However, some of the jet will still travel centrally down the nozzle. Hence, the abrasive distribution transversely across the jet within each of the areas defined by the lobes of the outlet orifice will define a standard bell-shaped distribution curve distribution as will the jet as a whole. Hence, with a two-lobed outlet orifice the abrasive distribution defines a curve made up of three overlapping bell-shaped distributions and similarly for outlet portions defining three or more lobes. The abrasive distribution across the whole of the outlet orifice is therefore more even than that in the prior art nozzles. The effect of this is that apart from the advantages of applying a jet with a more even abrasive distribution pattern, it also enables a greater quantity of abrasive to be entrained in any given fluid jet. Conventionally, when the central portion of the jet is fully abrasive laden, the jet cannot entrain any more without being choked. However, in the present invention, the more even distribution of the abrasive across the jet lowers the actual proportion of abrasive in any given part of the jet which means that it is capable of entraining a greater quantity. Hence, in use an operator need not repeatedly blast the same area of the surface to be blasted to the same extent as prior art nozzles to achieve an appropriate level of cleaning. Such a manner of working tends to damage the underlying surface because some areas will be blasted by a high level of abrasive to enable other areas to receive a minimum level. As a result, the nozzle according to the invention enables an operator to use broad sweeping motions, which are different from the circular and spiraling motions used by operators using conventional nozzles, so that each part of the surface to be blasted tends to receive the same level of abrasive. In addition, each sweep of the nozzle according to the invention provides a greater cleaning power than a prior art nozzle owing to the increased quantity of grit being ejected and enables the egressing jet to be very carefully controlled. In this way it will be appreciated that the whole blasting operation is thereby speeded up and becomes more efficient.

In fact, it has been found that with a nozzle according to the invention that the control it is now possible to exercise over the area receiving the blast enables very precise blasting operations to be carried out. For example, it is possible to remove white lining from asphalt surfaces without damaging the underlying and surrounding asphalt. Also, intricate brickwork and stonework on buildings can be cleaned without damaging the brickwork or stonework itself. Such damage is common when using a conventional nozzle, particularly along the edges and corners of mouldings which tend to be weak and easily chipped away. It is also possible for the nozzle to be used to remove individual layers of paint from structures such as metal bridges and ships. This means that top coats can be removed leaving an underlying primer coat underneath intact. This can be a considerable advantage as it can considerably reduce costs and time if only a replacement top coat need be reapplied to the structure.

Preferably, each splitter means comprises a linear ridge that is defined by a vertex between two interior surface areas of the outlet portion and that runs longitudinally along substantially the full length of the outlet portion.

Preferably also, each ridge defines a wedge-shaped profile that increases in width along the length of the outlet portion in a direction towards the outlet orifice.

Preferably also, the outlet portion defines two splitter means which run parallel to one another along opposite sides of the interior of the outlet portion and between them define a dividing line between the two lobes. In this case, the two lobes are preferably of identical shape, the dividing line comprising an axis of symmetry between the lobes.

In another embodiment, the outlet portion defines three splitter means that are spaced at angles of 120° around the circumference of the outlet portion and that divide the outlet portion into three lobes.

In a further embodiment, the outlet portion defines four splitter means that are spaced at angles of 90° around the circumference of the outlet portion and that divide the outlet portion into four lobes.

Preferably also, the interior surface areas of the lobes define a series of longitudinal grooves that run longitudinally along substantially the full length of the outlet portion. These grooves act as a form of rifling within the outlet portion and act to keep the entrained abrasive within the main portion of the jet after it has be ejected from the nozzle.

Preferably also, the accelerating portion comprises a venturi.

Preferably also, the nozzle is made from sintered carbide.

Preferably also, the nozzle has a resilient outer sheath, advantageously made of rubber.

BRIEF DESCRIPTION OF THE SEVERAL VIEWS OF THE DRAWINGS

The present invention will now be described by way of example with reference to the accompanying drawings.

DETAILED DESCRIPTION OF THE INVENTION

Figure 1:
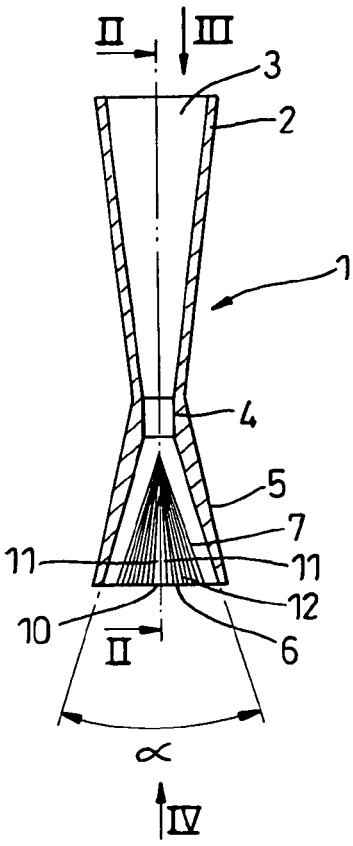
FIG. 1 is a longitudinal cross-section view of a first embodiment of blasting nozzle in accordance with the invention.
Figure 2:
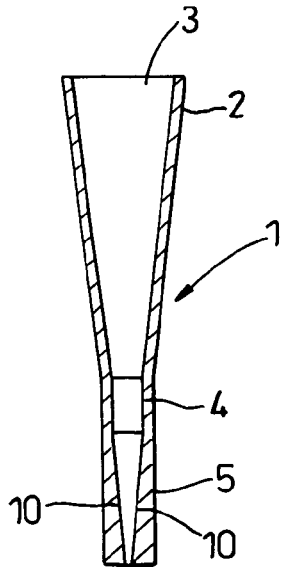
FIG. 2 is a longitudinal cross-section view along the line II—II in FIG. 1.
Figure 3:
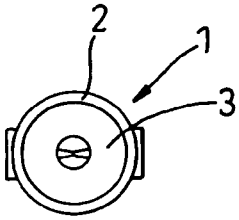
FIGS. 3 and 4 are end elevation views in the directions of the arrows III and IV in FIG. 1 respectively.

With reference to FIGS. 1 to 4, a first embodiment of a blasting nozzle 1 according to the invention comprises an inlet 2 for attachment to an outlet hose (not shown) of a conventional blasting apparatus, for example such as that described in WO 03/045633. The inlet 2 can be made in any appropriate shape for attachment to the apparatus but typically simply comprises a tubular portion with a circular orifice 3. Downstream of the inlet 2 is an accelerating portion 4 that, as in conventional nozzles, comprises a venturi. The inlet 2 therefore tapers to a short constricted portion prior to commencement of an outlet portion 5 through which an abrasive-laden fluid jet supplied from the blasting apparatus can be ejected and directed onto a surface to be blasted by an operator.

The outlet portion 5 is defines a single outlet orifice 6 and a single interior surface 7 which is shaped as will now be described to affect the abrasive distribution in the jet. The surface 7 flares from the constricted accelerating portion 4 outwards towards the outlet orifice 7 such that at its widest in one transverse direction the issuing jet defines an angle a that is of the order of 36°. However, the surface 7 is convoluted such that it defines two lobes 8*a*, 8*b* between which is located a splitter means 9. In the illustrated embodiment two splitter means 9 are provided but it would be possible for a single splitter means to be provided between the lobes 8 to still achieve a similar effect in the abrasive distribution pattern within the ejected jet. However, better results are obtained if two splitter means 9 are provided. As will be described with reference to FIGS. 5 and 6, if the nozzle comprises three or four lobes, then the same number of splitter means as lobes is a requirement.

Figure 4:
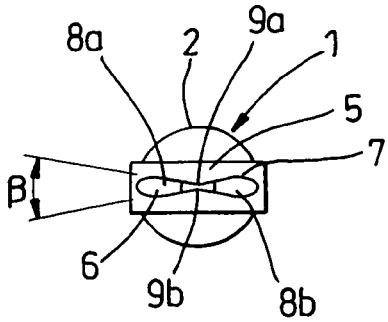

Each splitter means 9 comprises a linear ridge that is defined by a vertex 10 between two interior surface areas 11 of the outlet portion and that runs longitudinally along substantially the full length of the outlet portion 5. As shown in FIG. 1, the ridge 9 formed by the vertex 10 and surface areas 11 defines a wedge-shape that increases in width along the length of the outlet portion in a direction towards the outlet orifice 6. The two ridges 9 of this embodiment are parallel to one another and are formed along opposite sides of the interior of the outlet portion 5. In this way they define a dividing line between the two lobes 8. The lobes 8 are of identical shape so that the dividing line comprises an axis of symmetry between them. Hence, the overall interior shape of the outlet portion 5 can be compared to a fishtail with the outlet orifice 6 akin to the shape of a FIG. 8, each lobe 8*a*, 8*b* of the outlet orifice 6 flaring transversely by an angle β which is of the order of 21, as shown in FIG. 4. However, it must be stressed that the outlet orifice 6 remains a single orifice; the splitter means 9 directs the abrasive within the jet into one lobe 8*a* or the other 8*b* without actually splitting the jet itself into separate streams. In this way, the abrasive distribution transversely across the jet defines a standard bell-shaped distribution curve distribution but each of the areas defined by the lobes of the outlet orifice does likewise. Hence, in the present embodiment the abrasive distribution defines a curve made up of three overlapping bell-shaped distributions.

Figure 5:
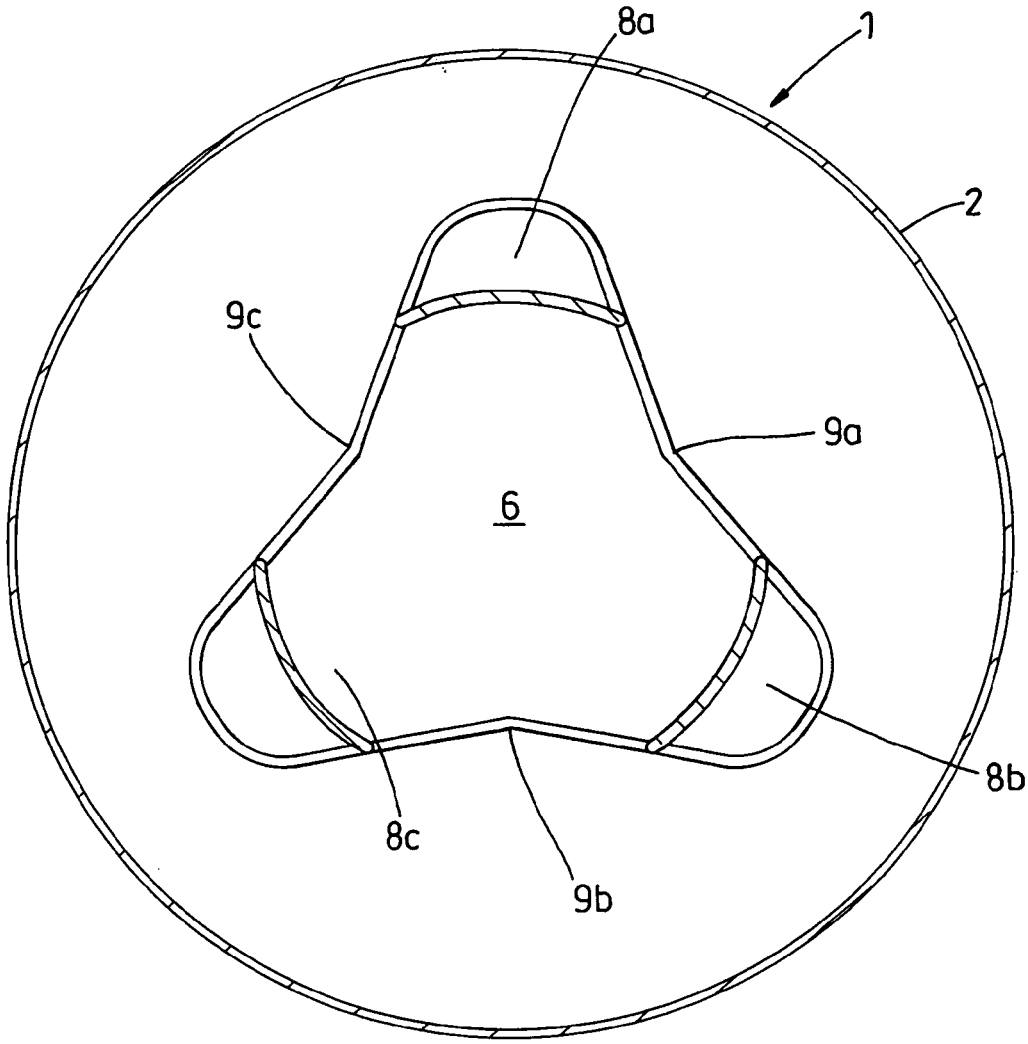
FIGS. 5 and 6 are end elevation views similar to FIG. 4 but of second and third embodiments of the blasting nozzle and to a considerably enlarged scale.

In the second embodiment as shown in FIG. 5, the outlet portion 5 defines three splitter means 9*a*, 9*b*, 9*c* that are spaced at angles of 120° around the circumference of the outlet portion 5 and that divide the outlet portion into three lobes 8*a*, 8*b*, 8*c*. Consequently, the abrasive distribution transversely across the jet is made up of four overlapping bell-curve distributions.

Figure 6:
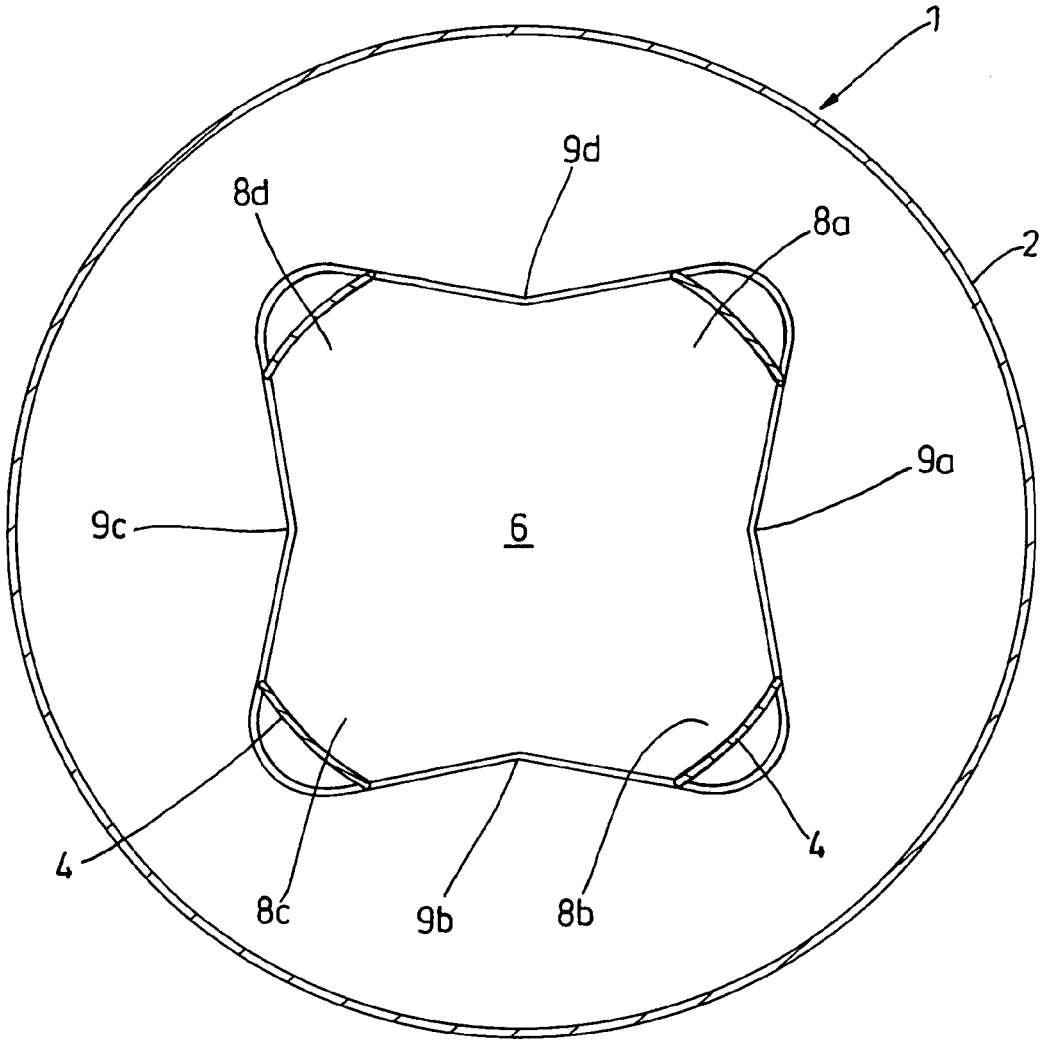

Similarly, in the third embodiment as shown in FIG. 6, the outlet portion 5 defines four splitter means 9*a*, 9*b*, 9*c*, 9*d* that are spaced at angles of 90° around the circumference of the outlet portion 5 and that divide the outlet portion into four lobes 8*a*, 8*b*, 8*c*, 8*d*. Hence, the abrasive distribution transversely across the jet is made up of five overlapping bell-curve distributions.

The second and third embodiments shown in FIGS. 5 and 6 enable a higher throughput of entraining fluid to be obtained and therefore a greater quantity of abrasive to be blasted over a considerably great area than with the first embodiment of nozzle 1. This is an advantage when large surface areas have to be blasted.

In order to ensure that the abrasive entrained within the fluid flow of the jet is retained within the jet after ejection from the nozzle and that the flow remains substantially linear, without eddy currents or turbulence, the interior surface areas of the lobes 8*a*, 8*b*, 8*c*, 8*d* in all of the embodiments of nozzle preferably define a series of longitudinal grooves 12 (see FIG. 1) that run longitudinally along substantially the full length of the outlet portion 5. These grooves 12 therefore act in a similar way to rifling.

The nozzle 1 is preferably fashioned from a one-piece casting and, in view of the considerable abrasion it will be subjected to by the abrasive passing down it is preferably made from sintered carbide but could be made from any suitable abrasive-resistant material. Likewise, to counteract any brittleness, which may result in it fracturing if dropped, it is preferably also provided with a resilient outer sheath or coating, advantageously made of rubber or a similar elastic material. In addition, the exterior of the sheath around the inlet 2 may be cylindrical in shape and provided with a screw-thread enabling the nozzle 1 to be attached by screwing to a suitable attachment at the end of a blasting hose.

It is also possible for the nozzle 1 to be made in two or more parts, for example the inlet 2 and accelerating portion 4 could be made separate from the outlet portion 5 and the two parts adapted by means of screw-threads or bayonet fastenings to be secured together during use. This would enable a set of differently shaped outlet portions 5, as described above, to be provided for attachment to the same inlet and accelerating portions, thereby facilitating their attachment in turn during any particular blasting job.

I claim:

1. A blasting nozzle for use in a blasting apparatus comprising:

a body for attachment to an outlet hose of said blasting apparatus, said body being comprised of an inlet through which an abrasive-laden jet is introduced into the nozzle, an accelerating portion for accelerating said abrasive-laden jet, and an outlet portion with a first interior surface that flares outwards to define a single outlet orifice through which said accelerated abrasive-laden jet is ejected from the nozzle, said outlet portion having a second interior surface that defines at least one splitter means such that a transverse cross-section profile of said outlet portion defines at least two lobes between the splitter means and said outlet orifice.

2. A nozzle as claimed in claim 1, wherein each splitter means comprises a linear ridge that is defined by a vertex between two interior surface areas of the outlet portion and that runs longitudinally along substantially the full length of the outlet portion.

3. A nozzle as claimed in claim 2, wherein each ridge defines a wedge-shaped profile that increases in width along the length of the outlet portion in a direction towards the outlet orifice.

4. A nozzle as claimed in claim 1, wherein the outlet portion defines two splitter means which run parallel to one another along opposite sides of the interior of the outlet portion and therebetween define a dividing line between two lobes.

5. A nozzle as claimed in claim 4, wherein the two lobes are of identical shape, the dividing line comprising an axis of symmetry between the lobes.

6. A nozzle as claimed in claim 1, wherein the outlet portion defines three splitter means that are spaced at angles of 120° around the circumference of the outlet portion and that divide the outlet portion into three lobes.

7. A nozzle as claimed in claim 1, wherein the outlet portion defines four splitter means that are spaced at angles of 90° around the circumference of the outlet portion and that divide the outlet portion into four lobes.

8. A nozzle as claimed in claim 1, wherein the interior surface areas of the lobes define a series of longitudinal grooves that run longitudinally along substantially the full length of the outlet portion.

9. A nozzle as claimed in claim 1, wherein the accelerating portion comprises a venturi.

10. A nozzle as claimed in claim 1, wherein the body is comprised of sintered carbide.

11. A nozzle as claimed in claim 1, wherein the body further comprises:

a resilient outer sheath or coating.

12. A nozzle as claimed in claim 1, wherein the body is comprised of at least two parts that are detachably secured together.

* * * * *